United States Patent [19]

Bittar et al.

[11] 4,352,410

[45] Oct. 5, 1982

[54] OPERATIONAL CONTROL OF ELEVATOR CAR CALLS

[75] Inventors: Joseph Bittar, Simsbury; Frederick H. Nowak, Southington, both of Conn.

[73] Assignee: Otis Elevator Company, Farmington, Conn.

[21] Appl. No.: 234,076

[22] Filed: Feb. 13, 1981

[51] Int. Cl.[3] ..... B66B 1/16

[52] U.S. Cl. ..... 187/29 R

[58] Field of Search ..... 187/29

[56] References Cited

U.S. PATENT DOCUMENTS

| | | | |
|---|---|---|---|
| 3,428,148 | 2/1969 | Jacobs | 187/29 |
| 3,586,133 | 6/1971 | Santysiak | 187/29 |
| 4,147,235 | 4/1979 | Henry et al. | 187/29 |
| 4,157,133 | 6/1979 | Corcoran et al. | 187/29 |

*Primary Examiner*—J. V. Truhe

*Assistant Examiner*—W. E. Duncanson, Jr.

*Attorney, Agent, or Firm*—M. P. Williams

[57] ABSTRACT

A microprocessor cab controller for an elevator car processes signals to control car calls by means of routines which prevent car calls from being registered behind the advancing direction of the car unless the car is headed for the lobby without further demand or the car has no advance direction, which responds to directives from a car controller mounted in the building to reset all car calls, reset selected car calls, reset the car call at a floor landing where the car is stopping, or force selected car calls; to inhibit car calls in a selected one of two zones of continuous floors for implementing dual up peak operation, and for selectively inhibiting registration of car calls at floors which are designated as cut off from service by the car. The invention allows use of the car call function for commanding special service and for inhibiting calls inconsistent therewith.

2 Claims, 6 Drawing Figures

OPERATIONAL CONTROL OF ELEVATOR CAR CALLS

1. Technical Field

This invention relates to elevators, and more particularly to utilization of selectively permitted and modified car calls as a functional part of elevator operational control.

2. Background Art

Elevators have car call panels including passenger-actuable switches for indicating landing stops requested by the passengers, and indicators to show which requests have been made. In most elevator systems known to the prior art, the indicators reflect the fact that the switch has been actuated whether or not the call can be answered for some reason (such as requesting an impermissible cutoff floor). In such systems, a car controller, usually located in the machine room at the head of the shaftway within which the elevator moves, receives the car call requests, but only acts on those which are permitted under the current operating circumstances. In the prior art, such car controllers also have the ability to establish and control the car in response to phanthom car calls; the phanthom car calls have the same effect on the car, but are not reflected in the indicators at the car call panel located in the car itself. Such a phanthom car call may be generated by the car controller in response to a directive from a group controller, such as to force the car to a floor where an express priority service switch has been actuated. In such a case, the directive from the group controller will also cause the car controller to ignore all other car calls which have been registered and indicated in the car call panel. Thus there is a disparity between the actual car call situation and that which is indicated to the passengers by the car call panel. There also arises a complexity in car controller operational controls with respect to which car calls have been requested, which of them are permitted, and which additional car calls (phanthom car calls) are to be made.

DISCLOSURE OF INVENTION

Objects of the invention include providing a simplified elevator system in which all of the calls to stop at floor landings, other than assigned floor landing calls, are instituted by registered car calls, said registered car calls including only those which are in fact permitted and also including phanthom car calls designated by the car controller in response to operating conditions of the car or in response to group directives. According to the invention, signal processing means located in the car is selectively responsive to car call buttons to register only those car calls being requested by passengers which are currently permitted car calls, is responsive to a car controller to inhibit recognizing any car call button signals, to reset all car calls, to reset the car call at the floor which the car is approaching for a service stop, to force selected car calls and to eliminate those of the registered car calls which are impermissible due to modified service directives commanded by a group controller. According to the invention further, the unitary car call command function is performed and retained within the car itself, and only the permitted requested car calls and/or forced car calls are indicated on the car call panel.

The invention eliminates, particularly, the disparity between the indicated car calls and the actual car calls which are permitted or commanded, rather than simply indicating that a call button has been depressed by a passenger. By performance of this function within the car itself, passengers making a normal depression of a car call button are quickly informed that the call has been accepted, or when they release the button are informed that the car call has not been accepted for some reason. The invention provides registering of inhibited floors for a variety of purpose within the car itself, as well as the capability to eliminate calls in response to directives sent to the car by the car controller on a cyclic basis. Because of the fact that car calls are cleared when answered, a car call panel always reflects the actual car calls remaining. This allows avoidance of reset of all car calls when reaching the furthest point of demand in one direction and reversing so as to travel in the other direction; this in turn permits late calls which are received just before passing a desired floor from being erased when motion reversal occurs, so that the call actually is retained, the other portions of the elevator system know that the call has been retained, the indication is maintained to the passenger, and the passenger will be served.

The invention provides for utilization of the unitary registered car calls signals, that is a single set of signals which indicate desired and permitted calls as well as forced calls, and not including any prevented or inhibited calls, to be reflective of functions commanded by the group controller (such as in canceling all prior car calls, inhibiting recognition of any further car call button requests, and forcing a single car call to a desired floor when the car is being taken over for express priority service). Other group functions are similarly readily implemented in this simplified fashion, with full indication to all parts of the system and the passengers of the currently permitted car calls. Thus all commanded stops, except those for answering routine hall calls in response to assignment thereof by the group controller, are commanded by the registered car calls.

This invention is readily implemented in a variety of ways utilizing apparatus and techniques which are well within the skill of the art in the light of the specific teachings with respect thereto which follow hereinafter.

Other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
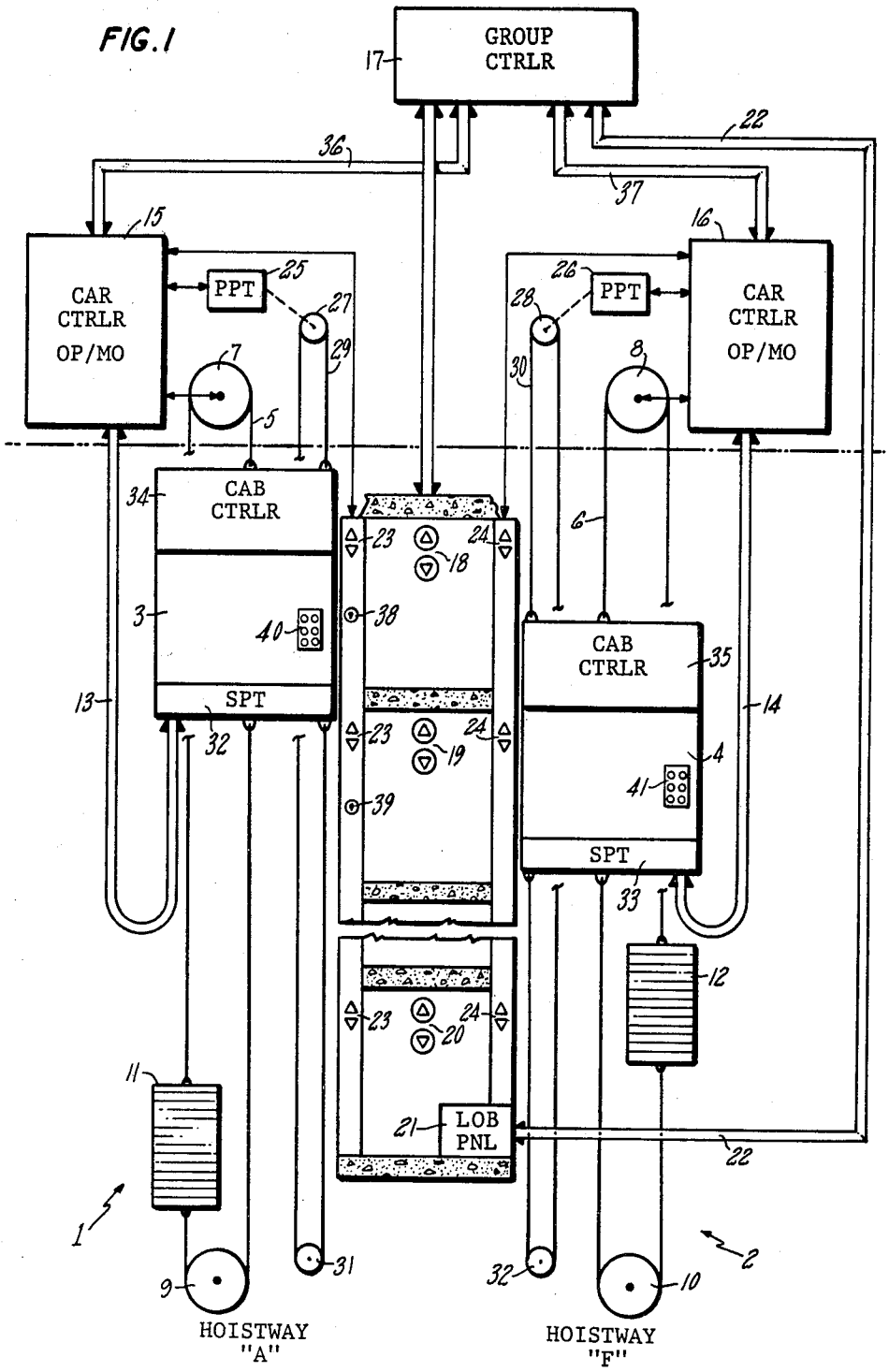
FIG. 1 is a simplified, schematic block diagram, partially broken away, of an elevator system in which the present invention may be incorporated.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven in either direction or held in a fixed position by a drive sheave/motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasi-absolute, incremental encoder and counting and directional interface circuitry of the type described in a commonly owned copending U.S. patent application of Marvin Masel et al., Ser. No. 927,242, filed on July 21, 1978, (a continuation of Ser. No. 641,798, filed Dec. 18, 1975, now abandoned), entitled HIGH RESOLUTION AND WIDE RANGE SHAFT POSITION TRANSDUCER SYSTEMS.

Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, By Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself may be directed, or communicated with, by means of a cab controller 34, 35 which may provide serial, time-multiplexed communications with the car controller as well as direct, hardwire communications with the car controller by means of the traveling cables 13, 14. The cab controller, for instance, will monitor the car call buttons, door open and door close buttons, and other buttons and switches within the car; it will control the lighting of buttons to indicate car calls,, and will provide control over the floor indicator inside the car which designates the approaching floor.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook," 1977–1978 Second Edition, published by Digital Equipment Corporation, Maynard, Mass., U.S.A. And, Simpson, W. E., Luecke, G., Cannon, D. L., and Clemens, D. H., "9900 Family Systems Design and Data Book," 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming," in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Design News), Boston, Mass., U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments' 9900 family, and suitable interface modules for working therewith, an elevator control system of the type illustrated in FIG. 1, which separate controllers for the cabs, the cars, and the group, has been implemented utilizing real time interrupts, in which power-on causes a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the communication register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 34, 35, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired. The controllers 15, 16, 17, may each be based on a microcomputer which may take any one of a number of well-known forms. For instance, they may be built up of selected integrated circuit chips offered by a variety of manufacturers in related series of integrated circuit chips, such as the Texas Instruments 9900 Family. Such a microcomputer may typically include a microprocessor (a central control and arithmetic and logic unit), such as a TMS 9900 with a TIM 9904 clock, random access memory, a read only memory, an interrupt priority and/or decode circuit, and control circuits, such as address/operation decodes and the like. The microcomputer is generally formed by assemblage of chips on a board, with suitable plated or other wiring so as to provide adequate address, data, and control busses, which interconnect the chips with a plurality of input/output (I/O) modules of a suitable variety. The nature of the I/O modules depends on the functions which they are to control. It also depends, in each case, on the types of interfacing circuitry which may be utilized outboard therefrom, in controlling or monitoring the elevator apparatus to which the I/O is connected. For instance, the I/Os which are connected to car call or hall call buttons and lamps and to switches and indicators may simply comprise buffered input and buffered output, multiplexer and demultiplexer, and voltage and/or power conversion and/or isolation so as to be able to sense cars hall or lobby panel button or switch closure and to drive lamps with a suitable power, whether the power is supplied by the I/O or externally.

An I/O module may provide serial communication over current loop lines 13, 14, 36, 37 between the car controllers 15, 16 and the cab controllers 34, 35 and the group controller 17. These communications include commands from the group controller to the cars such as higher and lower demand, stop commands, cancelling hall calls, preventing lobby dispatch, and other commands relating to features, such as express priority service when requested by a switch 38, 39. These communications also include information concerning car calls, normally requested by buttons in panels 40, 41 exchanged between cab and car controllers as well as the group controller. The group controller initiates communication with each of the car controllers in succession, and each communication operation includes receiving response from the car controllers, such as in the well known "handshake" fashion, including car status and operation information such as whether the car is in the group, is advancing up or down, its load status, its position, whether it is under a go command or is running, whether its door is fully opened or closed, and other conditions. And each car controller 15, 16 engages in similar communication with its own cab controller 34, 35. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends is unnecessary and not included herein.

Overall program structure of each controller, based upon a data processing system, in which the present invention may be practiced, is reached through a program entry point as a consequence of power up causing the highest priority interrupt, in a usual fashion. Then a start routine is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine in which all forcing (FORC) and all inhibit or cancel (INH) functions are cleared from memory; field adjustable variables are read and formatted as necessary; the status of each car is read and formatted as necessary; and all the hall calls and car calls are read, and corresponding button lights for sensed calls are lit. Then, all inputs obtained by communication between the cars, the cabs and the group are distributed to the various maps and other stored parameter locations relating thereto.

After initialization a variety of elevatoring functions are performed by various routines on various time bases. Such routines include assigning cars to answer hall calls, parking cars in zones, handling up peak and down peak traffic, and various other functions, including the emergency priority service described hereinafter with respect to the present invention. The car controllers 15, 16 may be implemented in a fashion similar to that described hereinbefore with respect to the group controller 17, having I/O devices suitable for communication with the cab controllers 33, 34 over lines 13, 14 and suitable for interacting with circuitry for controlling the sheave/motor/brake assemblies 7, 8 as well as any related transducers, such as the primary position transducers 25, 26. The car controller has a principal task of controlling the motion of the cab, and at times controlling the cab door. These functions necessarily include other, known subfunctions such as recognizing car calls, and responding to car calls or floor calls assigned by the group (or otherwise) in conjunction with the position of the cab to cause the cab to open and close its doors at appropriate times. Since these functions, and the communications between the various controllers to effect them, are, except as provided hereinafter with respect to the present invention, generally known and within the skill of the art, no particular aspect of them being involved herein except as provided hereinafter, further discussion thereof is not otherwise provided herein.

Figure 2:
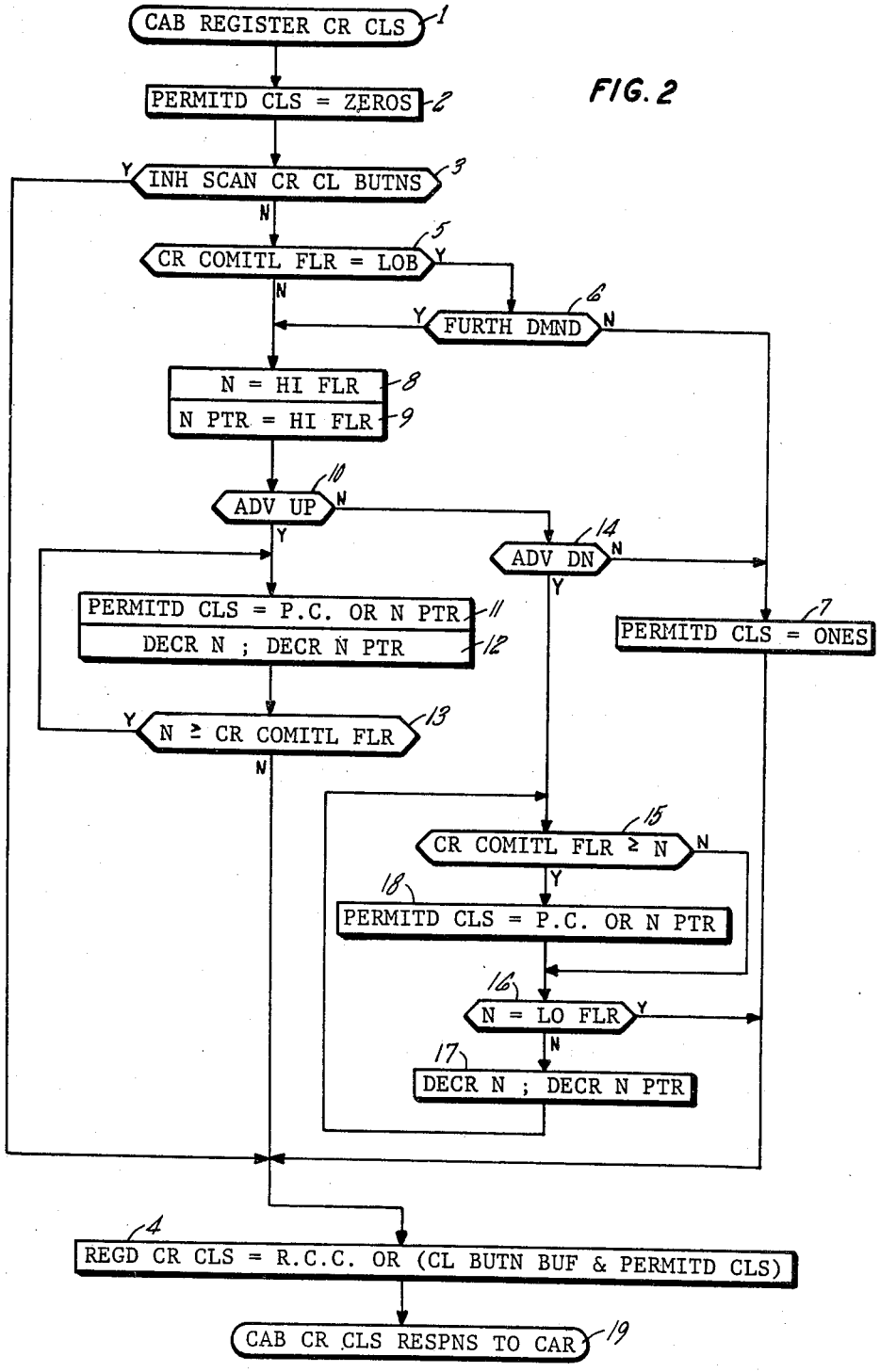
FIG. 2 is a simplified, logic flow diagram of a cab controller microprocessor routine for registering car calls.

Referring now to FIG. 2, the first of a series of routines within the microprocessor of the cab controller 34, 35 (FIG. 1) that controls car calls begins with a cab register car calls routine reached through an entry point 1. A first step 2 sets a map of permitted calls to all zeros. This map, described more fully hereinafter, is a map of calls that are not behind the car in the car demand direction. A test 3 determines if the car controller (15, 16, FIG. 1) has sent down a directive to inhibit scan of car call buttons. This directive may, for instance result from step 19, FIG. 7 of a commonly owned, copending application entitled ELEVATOR EXPRESS PRIORITY SERVICE, Ser. No. 234,080 filed on even date herewith by Bittar and Nowak. If it has, an affirmative result of test 3 will reach a step 4 in which a map of registered car calls is set equal to itself ORed with the ANDed combination of a call button buffer map, (indicative of call buttons which the cab car call panel I/O has indicated as having been pressed) and the map of permitted calls (which in this case is all zeros as a consequence of step 2). The concept in the routine of FIG. 2 is that the registered car calls map is updated by any call buttons which have been pressed that are not excluded due to being omitted from the map of permitted calls. The call button buffer in the microprocessor of the cab controller (34 or 35, FIG. 1) simply reflects words transferred thereto from the panel I/O on a repetitive cyclic basis in ordinary communication routines. Whenever a button in a panel 40, 41 is in the pressed state, by virtue of the presence of a passenger's finger thereon, that fact is registered in the ensuing cycle within which the routine of FIG. 2 is performed, by having a bit indicative thereof in the appropriate floor position of the call button buffer. When the button is released, the next communication from the panel I/O to the call button buffer will not have a bit for the particular floor, so updating of the call button buffer will cause that floor not to be represented therein. Previously registered calls (not otherwise reset or inhibited as described hereinafter) are retained in the register car calls map.

In FIG. 2, if scanning of car calls buttons is not inhibited, a negative result of test 3 will reach a test 5 for determining whether the car's committable floor is the lobby floor or not. If it is, an affirmative result of test 5 will cause a test 6 to determine whether the car has further demand (a need to run upward or downward) or not. If not, a negative result of test 6 will cause a step 7 to set the permitted calls map to all ones. Thus when a car is approaching the lobby and has no further demand, it will park at the lobby and await further use. Therefore, any calls are permitted since the car direction is not yet known until a passenger enters and decides whether to go up or down by selecting an appropriate floor. In this case, any new car call requests indicated by the call button buffer are added to the registered car calls in step 4 because all calls are permitted.

If the car is not approaching the lobby without further demand, either step 5 will be negative (the committable floor of the car is not the lobby) or step 6 will be affirmative (there is further demand). Then, the inhibition of car calls behind the direction of motion of the car becomes operative.

In FIG. 2, a step 8 sets a floor number, N, to the highest numbered floor of the building and a step 9 sets a floor pointer (N PTR) to the highest numbered floor of the building. Then a test 10 determines if the car motion direction is up or not. If it is, a step 11 adds to the previously zeroed map of permitted calls (step 2) the floor indicated by the N pointer by ORing the permitted calls map with the floor pointer. Then, a pair of steps 12 decrement the floor number and the floor pointer and a test 13 determines if the floor number is equal to or higher than the car committable floor. If it is, step 11 ORs another bit into the map of permitted calls representing the next lower floor in sequence. This proceeds iteratively until the floor number, N, is decremented to a point where it indicates a floor below the car committable floor. Thus, the floor represented by N when test 13 is negative is a floor which is behind the motion of the car. And, when test 13 is negative, the map of permitted calls will have added to it all of the floors from the top floor down to the committable floor of the car. Then, step 4 will update the registered car calls only by those floors in the map of the call button buffer which coincide with the map of permitted calls. Any attempt on the part of the passenger to register a car call for a floor equal to N (at the time that test 13 is negative), or any lower floor, will not be established in the map of registered car calls since it will have been omitted from the map of permitted calls.

In FIG. 2, in a similar fashion, if the car is not advancing upwardly, a negative result of test 10 will reach a test 14 which determines if the car is advancing downwardly. If it is, a similar permitted calls map is generated by starting at the lowest floor and adding bits to the map representative of every floor from the lowest floor to the committable floor of the car. Specifically, a test 15 determines whether the car committable floor is equal to or greater than the floor number represented by the N pointer. In the usual case, the car committable floor will be below the highest floor of the building so that initially test 15 has a negative result. This will test the value of N to see if it has been decremented to the lowest floor, but if not, a pair of steps 17 decrement N and the N pointer and test 15 is again made. Eventually N is decremented to the committable floor of the car so that step 15 will be affirmative. This will cause a step 18 to add to the map of permitted calls (which was reset to zeros in step 2) a bit at the position represented by the N pointer. Then unless the lowest floor is reached (test 16) steps 17 decrement N and the N pointer and test 15 is again performed for a next lower value of N. Subsequent to the first affirmative result of test 15, all subsequent passage through test 15 is affirmative so that as the N pointer is decremented down to the lowest floor, the map of permitted calls has added to it, successively, bits indicative of successively lower numbered floors in step 18. When the lowest floor is reached, the map of permitted calls is completed, step 16 will be affirmative, and step 4 will thus be reached.

In FIG. 2 if the car is not advancing upwardly or downwardly, having no demand and not running, test 14 will be negative and reach step 7 which causes the permitted calls to be a full map of ones, thus enabling any calls to be registered in step 4.

Figure 3:
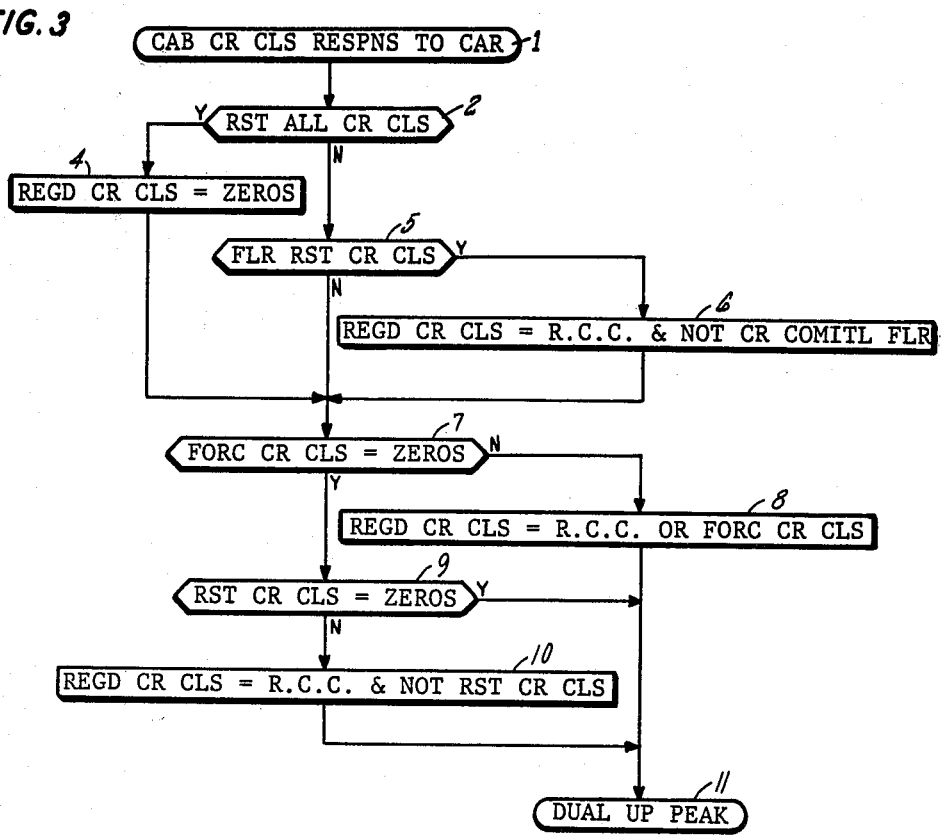
FIG. 3 is a simplified, logic flow diagram of a cab controller microprocessor routine for modifying registered car calls in response to directives from a car controller.

The routine of FIG. 2 thus allows updating (that is, adding to) the map of registered car calls, only those floors for which the call button buffer map indicates that call buttons are currently being depressed which coincide with permitted calls. And, permitted calls are limited to floors ahead of the committable position of the car in the direction in which it is advancing, except when the car is not advancing or is approaching the lobby with no further demand, in which case all calls are permitted. When step 4 has been completed in each pass through the routine of FIG. 2, a transfer point 19 (which may be a return point coupled with an appropriate sequence of routines) causes the cab car calls response to car routine of FIG. 3 to be reached through an entry point 1. In FIG. 3, a first test 2 determines if the car controller has sent down a directive to reset all car calls. This directive may be of the type indicated as subroutine 12 in FIG. 7 of the aforementioned ELEVATOR EXPRESS PRIORITY SERVICE application. In that case, all car calls are reset so as to permit setting a car call when the group determines that the car should answer an emergency priority service request. The setting of the car call is a mechanism by which the car is commanded to go to the floor where the emergency priority service is requested.

In FIG. 3 if all car calls are to be reset, an affirmative result of test 2 will reach a step 3 wherein the map of registered car calls (set in step 4 of FIG. 2) is reduced to all zeros. But if test 2 is negative, a test 5 determines whether the car has sent to the car a directive to reset a car call due to answering of such call. If it has, an affirmative result of test 5 will reach a step 6 wherein the map of registered car calls has the impending floor stop call removed therefrom by ANDing of itself with the complement of the map indicating the car committable floor. A test 7 determines if a map indicating car calls which should be foreced is all zeros or not. If it is not, a step 8 ORs that map with the map of registered car calls to have added, to the map of registered car calls, calls to the floors which are to be forced. The force car calls map tested in test 7 and utilized in step 8 may for instance be caused during emergency priority service by step 16 in FIG. 7 of the aforementioned ELEVATOR EXPRESS PRIORITY SERVICE application, which results from communication between the car controller and the cab controller which includes a map of force car calls bits to be used in test 7 and step 8.

In FIG. 3, a test 9 determines if a map of car calls to be reset is all zeros or not. If it is not, a negative result of test 9 reaches a step 10 in which the map of registered car calls has certain calls deleted therefrom by being ANDed with the complement of the map of car calls to be reset. The routine of FIG. 3 is then complete, having reset all car calls, reset the call at the floor where the car is about to stop, force selected car calls in response to the car controller, or reset selected car calls in response to the car controller. The program will then advance, either by return and calling the next program in sequence or directly, to the dual up peak routine through a transfer point 11.

Figure 4:
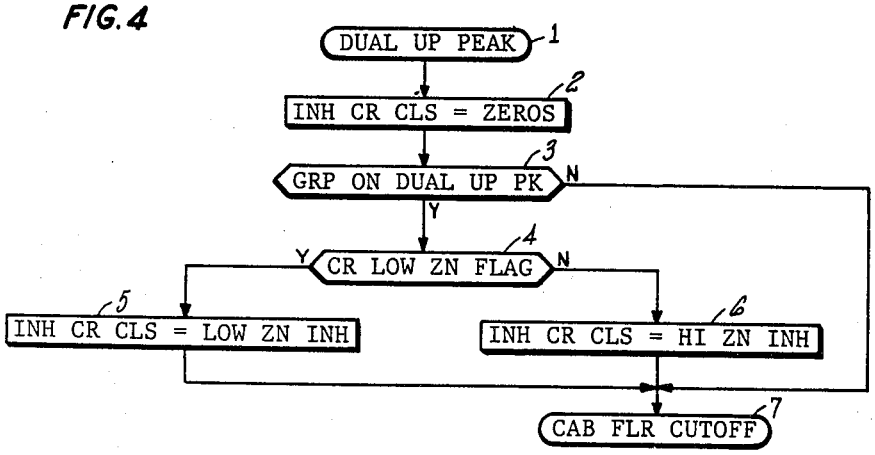
FIG. 4 is a simplified, logic flow diagram of a cab controller microprocessor routine for modifying car calls to implement dual up peak elevator operation.

In FIG. 4, the dual up peak routine is reached through an entry point 1 and a first step 2 resets a map of inhibited car call floors to all zeros. When a test 3 determines if the group has communicated to the car, and the car in turn has communicated to the cab, the fact that the group is on dual up peak mode of operation. This is a mode of operation which may utilize, for instance, the basic up peak dispatching described in a commonly owned U.S. patent application entitled VARIABLE ELEVATOR UP PEAK DISPATCHING INTERVAL, Ser. No. 99,394, filed on Dec. 3, 1979 by Bittar and Mendelsohn. In dual up peak, the only variation is that the cars are identified as being for passengers to reach a zone of lower floors or is identified as being for the passengers to reach a zone of upper floors. The dual up peak manipulation of car calls assures the fact that no car calls can be registered for the opposite zone. In other words, if one enters the car during dual up peak which is scheduled for low floor zone service, no car calls will be permitted above the low floor zone. Similarly, no calls are permitted below the lowest floor in the higher zone of a car which is servicing the higher numbered floors during dual up peak.

In FIG. 4 if the cab controller has been told that the group is on dual up peak dispatching, an affirmative result of test 3 will reach a test 4 in which a car low zone flag is interrogated. This flag is similarly sent from the group, to the car, to the cab to indicate to the cab whether this elevator is working as a low zone car or as a high zone car. Normally, the group itself will be told when dual up peak is in place and the cars will be designated as low zone or high zone cars in response to switch inputs made by a dispatcher on the lobby panel 21 (FIG. 1), but dual up peak may be controlled by a real time clock, and the designation of cars in the high or low zone can be permanently or semi-permanently established by maintenance switches, or read only memory fixed words, or in some other fashion.

In FIG. 4 if test 4 is affirmative, then a map of car calls to be inhibited is set equal to a low zone inhibit map in a step 5, and if test 4 is negative, the map of car calls to be inhibited is, instead, set to be equal to a high zone inhibit map in a step 6. When the dual up peak routine of FIG. 4 is completed by setting a map to inhibit car calls in either a high zone or a low zone, or resetting it to all zeros and leaving it that way, the program proceeds to the cab floor cutoff routine through a transfer point 7.

Floor cutoff (preventing car calls to prohibited floors, such as banking floors after hours) is controllable by switches on the lobby panel (21, FIG. 1) or in response to real time clock initiation thereof, as governed by maps of cars versus inhibited floors. The group controller must send directives to any involved car controller, which in turn sends directives to its cab controller to initiate or terminate cutoff of one or more floors.

Figure 5:
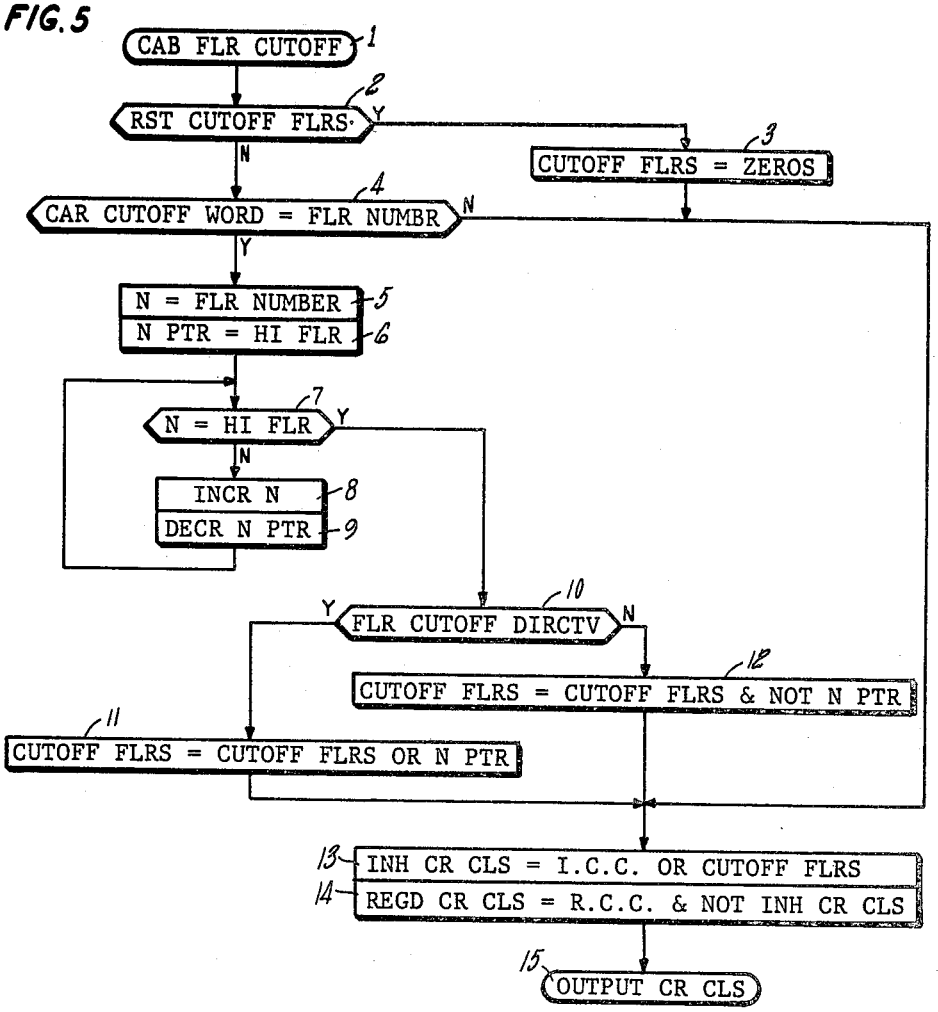
FIG. 5 is a simplified, logic flow diagram of a cab controller microprocessor routine for inhibiting car calls to implement floor cutoff operating.

In FIG. 5, the cab floor cutoff routine is reached through an entry point 1 and a first test 2 interrogates a directive sent to the cab from the car indicating that all cutoff floors should be reset. An affirmative result of test 2 causes a step 3 to reset a map of cutoff floors to all zeros. This has the effect of restoring all of the floors to service by the particular elevator car in question. If test 2 is negative, a test 4 determines whether a particular word sent to the car relating to the cutoff of service to certain floors has a valid floor number in it. If it does, the floor number indicated in the word which is interrogated in step 4 is utilized in a small routine to create a floor pointer indicating the floor of the floor number. Thus a number, N, is set equal to the floor number contained in the word, and an N pointer is set equal to the highest floor of the building in steps 5 and 6. Then a test 7 determines if the floor number, N, is equal to the highest floor of the building; if not, steps 8 and 9 increment the floor number and decrement the floor pointer. This continues until the floor number is equal to the highest floor of the building in which case an affirmative result of test 7 causes this iterative process to terminate. As a consequence, the N pointer is rotated left (to indicate a successively lower numbered floor) for each increment of N. Thus, if the floor number of the floor to be cut off is the 12th floor in a sixteen story building, the floor number would be incremented four times so that the N pointer would advance from 16 through 15, 14 and 13, to 12.

In FIG. 5, a test 10 interrogates a floor cutoff directive which is included with the floor number in a cutoff word sent from the car to the cab. If test 10 is affirmative, this indicates that the floor represented by the floor number is to be cut off from service. But if step 10 is negative, this indicates that the floor indicated by the floor number is to have its cutoff status removed, and again become available for service by this elevator. Therefore, an affirmative result of test 10 will cause a step 11 to cause the map of cutoff floors to be updated by adding to it the floor indicated by the N pointer (indicating the floor number in the cutoff word) by having the N pointer ORed into it. But if test 10 is negative, a step 12 has the particular floor removed from the map of cutoff floors by ANDing the map of cutoff floors with the complement of the N pointer.

In FIG. 5, if test 2 indicates that the cutoff floors are not to be all reset, and test 4 does not find a valid floor number in a cutoff word sent down by the car, a negative result of step 4 causes the same steps 13–15 to be reached as is the case when either step 3 resets all of the cutoff floors or step 11 or 12 alters the map of cutoff floors. In step 13, the map of car calls to be inhibited (which may be established in steps 2 and 5 or 6 of FIG. 5) is updated by ORing it with a map of cutoff floors. And then the registered car calls map is updated by deleting any car calls which are inhibited (either as a result of cab floor cutoff or as a result of dual up peak) by ANDing the complement of the map of car calls to be inhibited with the map of registered car calls in a step 14. Then the routine is complete and the program may proceed to suitable other parts of the program, such as the output car calls routine, through a transfer point 15.

In FIG. 5, except when a cutoff directive (tests 4 and 10) is first sent to the cab controller by the car controller, or when all cutoff floors are restored (test 2), the map of cutoff floors will be retained, cycle after cycle. Thus, a floor can be cutoff by sending one directive (e.g., in the late afternoon) and it will remain cutoff until a restoring directive is sent (e.g. the following morning), due to the negative result of test 4 not altering the map of cutoff floors used in steps 13 and 14.

Figure 6:
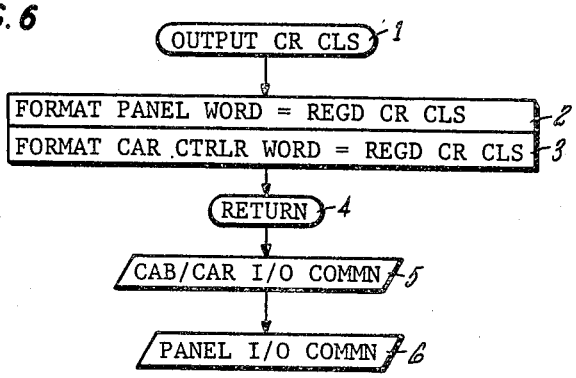
FIG. 6 is an exemplary, simplified, logic flow diagram illustrative of ancillary functions which may be performed in the cab controller in utilization of car calls modified in accordance with the invention.

The map of registered car calls is contemplated herein as being usable to indicate to the car controller (15, 16, FIG. 1), as well as to the car call button panel (40, 41, FIG. 1) within the cab, those floors for which valid car call commands are recognized. The car controller uses this information, for instance, to control stopping of the car at desired floors. This may be achieved in a fashion described in a commonly owned, copending U.S. patent application entitled ELEVATOR FLOOR STOP LOOK-AHEAD, Ser. No. 267,281, filed on May 27, 1981 by Sheehy and Bittar, or in any other suitable known fashion. Additionally, the registered car calls map is utilized at the panel (40, 41, FIG. 1) to refresh the buttons (or adjacent lights) which are to be illuminated in the next cycle of operation. That is to say if the registered car calls map is reset to all zeros (such as in step 4 of FIG. 3), then all of the call button lights in the panel of the car will become dark in a next succeeding cycle. The manner of outputting the registered car calls map to the car and to the call button panel may take any suitable form, utilizing ordinary data communication techniques. As a mere example thereof, FIG. 6 illustrates that an output car calls routine, entered through a point 1, may have steps 2, 3 to format appropriate words including the map of registered car calls for transmission to the car call button panel and to the car controller, respectively. Thereafter, returning to the other parts of the program through a return point 4, other routines 5, 6 are reached which represent normal communications through I/O devices of the cab controller and the car controller to communicate the formatted word appropriately. In such a system, the depression of a call button may force a bit in a temporary call button register, the content of the temporary call button register being transferred from the car panel I/O to the microprocessor call button buffer (that referred to in step 4 of FIG. 2). The permitted calls, resets and inhibits controlling modification of the existing registered car calls map, and the modified registered car calls map may be returned to control the buttons or indicator lights for the various floors, as well as being sent to the car to indicate to the operation control portion of the car controller which car calls have been registered in the cab controller.

The use of "registered car calls" as the only source of landing stop directives (other than assigned hall call stops), with only permitted calls registered therein provides simplicity and correspondence between the permitted and phantom calls and the call panel indicators. Performing these functions within the car itself, in proximity to the car call panel allows indicating only accepted calls (as well as forced, phantom calls) without any undue delay (such as might occur if these functions were performed in the car controllers 15, 16, FIG. 1).

Thus, the passengers know all calls and know that when their calls are indicated, they will be answered, and this occurs without the need to hold the car call button for more than one major cycle of the cab controller microprocessor (about one-fifth of a second).

The invention provides certain functions in its own right in response to special service directives, such as express priority service, received from the group controller, and provides a basis for accommodating functions of other inventions. For instance, step 4 of FIG. 2 prevents recognition of any further passenger-initiated car calls whenever the cab controller receives the inhibit scan car call buttons directives of test 3 in FIG. 2. And, the routine of FIG. 2 also provides a basis to accommodate the prevention of recognizing passenger-initiated car calls for floors which are behind the car in its present direction of advancement, as is described and claimed in a commonly owned, copending U.S. patent application entitled PREVENTING ELEVATOR CAR CALLS BEHIND CAR, Ser. No. 234,178, filed on even date herewith by Bittar. In a similar fashion, the routines of FIG. 4 and FIG. 5 are examples of the manner in which stored maps of floors to be inhibited (such as the low zone inhibit and high zone inhibit maps of steps 5 and 6, FIG. 4 and such as the cutoff floors map of steps 11–13 in FIG. 5) by the group in response to group modified service directives (such as dual up peak and cab floor cutoff, respectively) as well as forming a simplified manner in which the cab floor cutoff can be implemented, as is described and claimed in a commonly owned, copending application entitled ELEVATOR FLOOR CUTOFF, Ser. No. 234,077, filed on even data herewith by Nowak and Bittar. The invention also provides the framework for resetting answered calls (step 6, FIG. 3) so that the panel reflects only calls which are to be answered. This feature eliminates the need for resetting all car calls or for resetting the indicators on the car call panel at the reversal of direction of elevator movement, thereby permitting retention of calls when changing from one direction to another. And the invention provides the mechanism of not only failing to recognize further car call requests by passengers, but getting rid of those which have already been registered, such as in step 4 of FIG. 3. The invention provides the opportunity for operational controls in the car controller or for group controls to utilize the car calls to control car operation in special cases. For instance, the car may provide a map of forced car calls (test 7 and step 8 of FIG. 3) in response to a group directive ( such as when the group is commandeering the car to answer an express priority service call at a specific floor), or in response to safety or other functions in the car controller (such as loss of primary power and the desire to stop at the very next floor).

The invention also provides for a mechanism of inhibiting car calls by the stored maps (steps 5 and 6, FIG. 4, steps 11 and 12, FIG. 5) where the maps may be retained but the map of inhibit car calls is reestablished in every cycle (due to step 2, FIG. 4). On the other hand, there is a capability to have permanent storage of prevented car calls by means of a reset car call map (test 9 and step 10 of FIG. 3) for use in appropriate circumstances as desired. Thus, the map of step 10, FIG. 3 may be utilized whenever it is desired to not have to refresh the resetting on every cycle for assurance that the call will be prevented (such as with jammed hatch at a floor landing) in contrast with the flexibility permitted by use of the inhibit car calls maps of FIGS. 4 and 5.

This invention as shown is implemented in exemplary programs to be carried out by well known microprocessors within the cab controller. However, the cab controller could have these functions implemented with different, though similar programs or with dedicated digital or analog hardware, in a manner which should be obvious in view of FIGS. 2–6 to those skilled in the art. And, it should be understood that the disclosure herein is exemplary and not exhaustive, and similar other control over the net, unitary, effective registered car calls function may be provided to suit implementation of various features of service and control in an elevator system.

Thus, although the invention has been shown and described with respect to exemplary embodiments thereof, it should be understood by those skilled in the art that the foregoing and various other changes, omissions and additions may be made therein and thereto, without departing from the spirit and the scope of the invention.

We claim:

1. An elevator system including a group of elevators movable in shaftways for servicing a plurality of floor landings in a building, comprising:

group controller means for providing group demand controlling signals to said elevators to cause said elevators to move to selected landings;

each of said elevators including:

a car disposed for movement in the related one of said shaftways, a car call panel disposed in said car and having passenger-actuable means for providing car call button signals indicative of landings at which elevator stops are requested by passengers and indicator means for providing visual indication of landings for which car calls have been requested, and signal processing means for providing registered car call signals in response to said car call button signals;

car motion means for providing and arresting motion of said car;

a car controller, disposed in said building, interconnected with said car and with said car motion means for providing signals to said car motion means to cause movement of said car to landings indicated by said registered car call signals and said group demand controlling signals;

characterized by said group controller means comprising means for providing special service signals to each of said elevators and for providing modified service signals to each of said elevators, said service signals designating landings corresponding thereto;

said car controller means comprising means for providing inhibit car call buttons signals in response to said special service signals provided thereto by said group controller means, for providing a floor reset signal indicative of said car motion means bringing said car to a landing for a service stop thereat, for providing a reset all car calls signal and force car calls signals, indicative of landings at which service stops are to be made, in response to said special service signals provided thereto by said group controller means, and for providing group car call inhibit signals in response to said modified service signals provided thereto by said group controller means; and said signal processing means comprising means for providing a register of permitted call signals designating floors for which registered car calls are permitted, for providing registered car call signals in response to ones of said call button signals corresponding to floors designated in said register of permitted call signals, for eliminating all floor designating signals in said register of permitted call signals in response to said inhibit car call buttons signal being provided thereto, for eliminating all of said registered car call signals in response to said reset all car calls signals, for eliminating ones of said registered car call signals corresponding to floors at which a service stop is to be made as indicated by said floor reset signal, for providing registered car call signals corresponding to floors designated by said force car calls signals, for providing a register of inhibit car call signals in response to said group car call inhibit signals, for eliminating selected ones of said registered car call signals in response to said register of inhibit car call signals, and for providing said registered car call signals, as modified in response to said reset all car calls signals, said floor reset signal, said force car calls signals, and said inhibit car call signals, to said car controller and to said indicator means.

2. An elevator system according to claim 1 characterized by:

said car controller means comprising means providing said group car call inhibit signals in the form of functional directive signals and corresponding landing designating signals indicative of one or more landings to become respectively inhibited or uninhibited thereafter, and for providing call reset signals indicative of landings corresponding to which car calls are to be eliminated until different call reset signals are provided; and said signal processing means comprising means cyclicly operative in a repetitive sequence for providing a register of said call reset signals for use in subsequent cycles, for eliminating selected ones of said registered car call signals in response to said register of call reset signals, for providing a plurality of registers of landing inhibit signals, each corresponding to one of said functional directive signals and retaining landing inhibit signals designating landings for which car calls are to be eliminated in conjunction with the related function in subsequent cycles, and for providing in each cycle said register of inhibit car call signals in response to said plurality of registers of landing inhibit signals.

* * * * *